US006286294B1

(12) United States Patent
Suzuki

(10) Patent No.: US 6,286,294 B1
(45) Date of Patent: Sep. 11, 2001

(54) WIRE STRANDING MACHINE

(75) Inventor: Kanji Suzuki, Tokyo (JP)

(73) Assignee: Kinrei Machinery Co., Ltd., Tokyo (JP)

( * ) Notice: Subject to any disclaimer, the term of this patent is extended or adjusted under 35 U.S.C. 154(b) by 0 days.

(21) Appl. No.: 09/432,314

(22) Filed: Nov. 2, 1999

(30) Foreign Application Priority Data

Nov. 5, 1998 (JP) ..... 10-314638

(51) Int. Cl.[7] ..... D01H 05/28

(52) U.S. Cl. ..... 57/315; 57/58.34; 57/58.49; 57/58.52; 57/58.65; 57/59; 57/237; 57/315

(58) Field of Search ..... 19/115 A; 57/58.34, 57/58.49, 58.52, 58.65, 59, 237, 315; 74/506; 226/189; 242/364.2, 364.11, 364.12

(56) References Cited

U.S. PATENT DOCUMENTS

| | | |
|---|---|---|
| Re. 26,757 | 1/1970 | Vibber . |
| 267,279 | 11/1882 | Strohm . |
| 297,175 | 4/1884 | Shelburne . |
| 1,629,168 | 5/1927 | Massingham . |
| 1,684,511 | 9/1928 | O'Donnell . |
| 2,002,975 | 5/1935 | Brooks . |
| 2,010,888 | 8/1935 | Pool . |
| 2,723,525 | 11/1955 | Blaisdell . |
| 2,773,344 | 12/1956 | Van Hook . |
| 2,787,653 | 4/1957 | Ormerod . |
| 2,958,724 | 11/1960 | Milloit . |
| 3,052,079 | 9/1962 | Henning . |
| 3,067,569 | 12/1962 | Kelly, Jr. . |
| 3,142,952 | 8/1964 | Kraft et al. . |
| 3,147,580 | 9/1964 | Blaisdell et al. . |
| 3,382,314 | 5/1968 | Nordblad . |
| 3,676,576 | 7/1972 | Dubernet . |
| 3,756,004 * | 9/1973 | Gore ..... 57/11 |
| 3,857,996 | 12/1974 | Mansen . |
| 4,100,721 | 7/1978 | Seiichi . |
| 4,133,167 | 1/1979 | Schofield . |
| 4,182,105 | 1/1980 | Tokuji . |
| 4,222,221 | 9/1980 | Lenorak . |
| 4,227,041 | 10/1980 | Den et al. . |
| 4,300,339 | 11/1981 | Orlandi et al. . |
| 4,328,662 | 5/1982 | Bretegnier et al. . |
| 4,404,424 | 9/1983 | King et al. . |

(List continued on next page.)

FOREIGN PATENT DOCUMENTS

| | | |
|---|---|---|
| 0299123A2 | 1/1989 | (EP) . |
| 2542545 | 9/1993 | (JP) . |
| 8-6269 | 12/1994 | (JP) . |
| 2717396 | 6/1997 | (JP) . |

*Primary Examiner*—John J. Calvert
*Assistant Examiner*—Shaun R Hurley
(74) *Attorney, Agent, or Firm*—Weingram & Associates, P.C.

(57) ABSTRACT

A wire stranding machine is provided, being capable of stranding the wire materials evenly and uniformly even if two wire materials are used, by installing the capstan assembly outside of the rotary structure on the wire incoming side. A rotary structure having the winding drum inside of a flyer bow is supported by main shafts, and the capstan assembly is disposed adjacent to the main shaft on the wire incoming side. The capstan assembly includes a pair of capstan members consisting of main and auxiliary capstans, each having plural grooves on the outer circumferential surface thereof, and the main capstans are set opposite to each other. The capstan assembly is so arranged that the main and auxiliary capstans are set on the mounting member of the main shaft supporting the rotary structure and disposed parallel in the direction perpendicular to the axis of the main shaft. The main capstans are adapted to rotate at the same speed but in opposite directions to each other.

6 Claims, 4 Drawing Sheets

U.S. PATENT DOCUMENTS

| | | | | |
|---|---|---|---|---|
| 4,445,593 | | 5/1984 | Coleman et al. . | |
| 4,446,688 | | 5/1984 | Ueda . | |
| 4,461,923 | | 7/1984 | Bogese . | |
| 4,486,623 | | 12/1984 | Ploppa . | |
| 4,545,190 | | 10/1985 | Rye et al. . | |
| 4,570,428 | * | 2/1986 | Blackmore | 57/58.65 |
| 4,634,102 | * | 1/1987 | Appling et al. | 254/278 |
| 4,654,476 | | 3/1987 | Ottler . | |
| 4,677,256 | | 6/1987 | Bauer et al. . | |
| 4,680,423 | | 7/1987 | Bennett et al. . | |
| 4,734,544 | | 3/1988 | Lee . | |
| 4,754,102 | | 6/1988 | Dzurak . | |
| 4,759,487 | | 7/1988 | Karlinski . | |
| 4,777,325 | | 10/1988 | Skinski . | |
| 4,937,401 | | 6/1990 | Lee . | |
| 4,945,189 | | 7/1990 | Palmer . | |
| 5,118,278 | | 6/1992 | Nishitima . | |
| 5,287,691 | | 2/1994 | Okamato . | |
| 5,424,491 | | 6/1995 | Walling . | |
| 5,493,071 | | 2/1996 | Newmoyer . | |
| 5,767,441 | | 6/1998 | Brorein . | |

* cited by examiner

WIRE STRANDING MACHINE

BACKGROUND OF THE INVENTION

Field of the Invention

The present invention relates to a wire stranding machine, and more particularly to the wire stranding machine capable of stranding wires evenly.

According to the prior art, the capstan is located inside the rotary structure and just in front of the winding drum, and the wire material is being stranded as well as given a tension at the time of passing through the flyer bow. But because of the long distance between the wire supply position and the capstan, there may cause an irregular pitch in stranding the wires thereby resulting in an unevenly stranded product even if the wires were pulled with a given tension.

The reasons for this defective product are because the wires are supplied in a free condition relative to the rotary structure and also because the wires slacken under the influence of the wind force generated by the rotary structure. Particularly in case of stranding two wires, it was an important requirement to pull them uniformly. If one wire is pulled with a stronger force than the other, the former will become straight with the latter being coiled around, resulting in an inferior product as stranded wires.

OBJECTS AND SUMMARY OF THE INVENTION

The present invention comprises a capstan disposed at the wire supply side outside of the rotary structure, so as to improve the accuracy in stranding the wires and provide evenly stranded wires even in case of using two wires.

According to the invention, means for solving the problems comprises a shaft-supported rotary structure including a winding drum disposed at the inner side of flyer bows, and a capstan assembly disposed adjacent to the shaft on the wire incoming side. The capstan assembly comprises a pair of capstan means, each capstan means consisting of main and auxiliary capstans having plural grooves on the outer circumferential surface thereof and said main capstans being located opposite to each other. The two main capstans are adapted to rotate at the same speed but in opposite directions.

On the shaft supporting the rotating structure, the main and auxiliary capstans in pairs are arranged parallel to each other in the direction perpendicular to the axial direction of said shaft, and the main capstans are arranged opposite to each other symmetrically to the center of the axis.

Further, the capstan assembly is characterized in that the main capstans are of the same diameter.

Still further, the capstan assembly is arranged so that main capstans have engaging gears mounted on the rotary shafts of said main capstans and the rotary shafts are connected to a rotation drive means.

Still further, the capstan assembly is arranged so that the auxiliary capstans slant slightly relative to the rotary structure.

A member for mounting the rotary shafts of the main and auxiliary capstans is formed with a cut therebetween, with the portion mounted with the auxiliary capstan being raised so as to slant the auxiliary capstan to the rotary structure.

BRIEF DESCRIPTION OF THE DRAWINGS

For a more complete understanding of the present invention, reference may be had to the following description of exemplary embodiments of the present invention considered in connection with the accompanying drawings, in which.

DETAILED DESCRIPTION OF THE PREFERRED EMBODIMENTS

Figure 4:
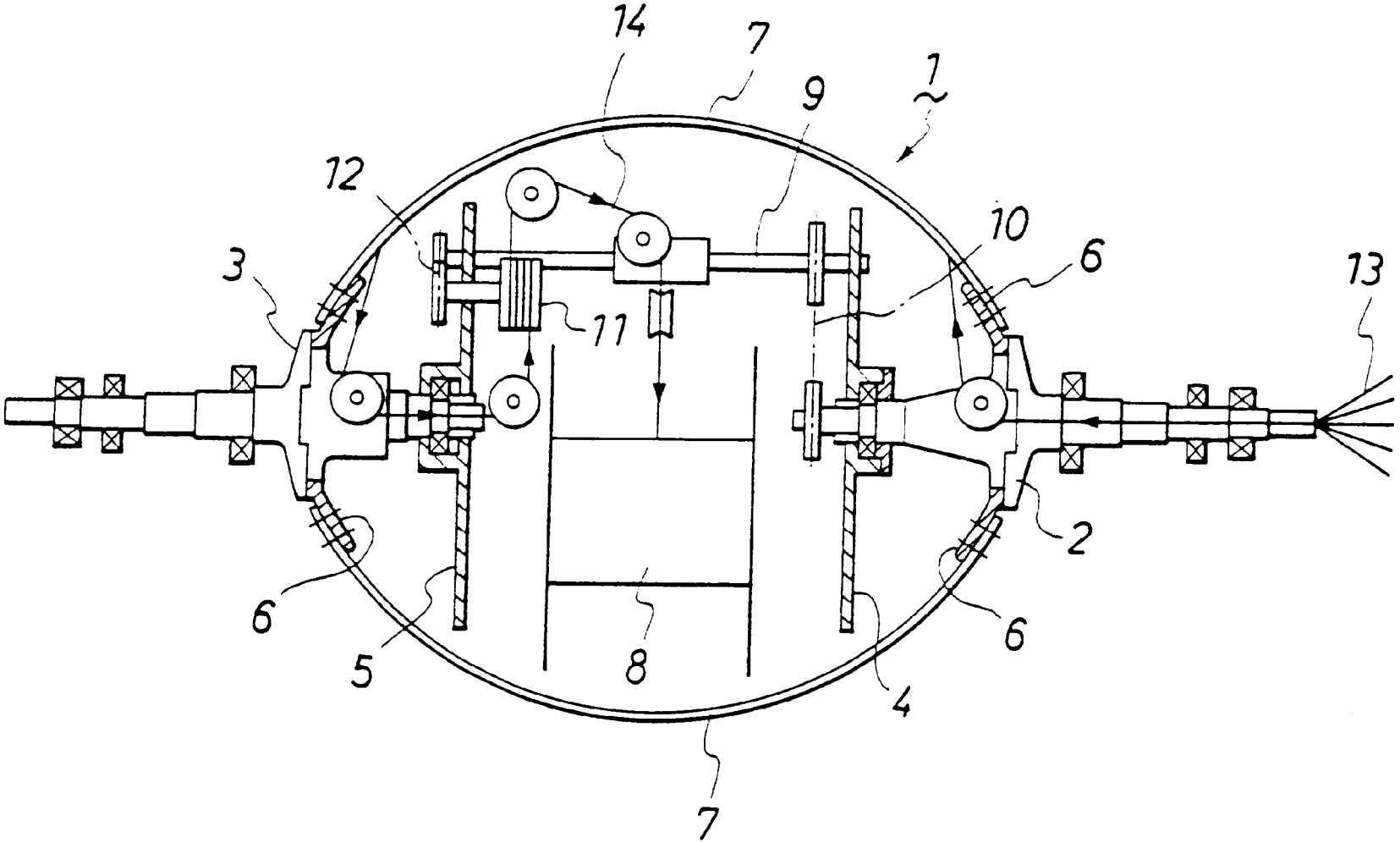
FIG. 4 is a front view of the rotary structure of a conventional wire stranding machine.

FIG. 4 shows a conventional wire stranding machine, in which a rotary structure 1 is an assembly comprising a drive-side member 2, a capstan-side member 3, and rotary discs 4 and 5, said rotary discs being disposed to the front of said members and connected by a rod not shown. Flyers 6 are provided on the drive-side member 2 and the capstan-side member 3, and a pair of flyer bows is mounted exchangeable to said flyers 6. The drive-side capstan 2 and the capstan-side member 3 are mounted rotatable to a drive means not shown. Inside and between the rotary discs 4 and 5, there is provided a detachable winding drum 8 for winding the stranding wires.

The facing surfaces of the rotary discs 4 and 5 are mounted with a rotatable transmission shaft 9 which is disposed out of alignment with the center of rotation. The transmission shaft 9 is adapted to rotate in association with the drive of the machine 1 via a belt 10 mounted on pulleys fixed to said shaft 9 and the drive-side member 2. On the other hand, a capstan 11 is mounted rotatable to the capstan-side rotary disc 5 and connected to the transmission shaft via a belt 12 mounted on the shaft of the capstan and the transmission shaft 9 so as to receive the rotation from the machine 1.

Generally, the flyer bow is 1000 to 1800 mm long and the wire stranding machine runs at 3000 to 4000 revolutions per minute.

As the machine operates the flyer bow 7 into rotation, plural wires 13 are twisted into a strand 14 while they are passing from the drive-side member 2 through the flyer bow 7 to the capstan 11, and the strand 14 is then wounded by the winding drum 8. The capstan 11, consisting of a pair of wheels each formed with plural grooves thereon, is adapted to receive the strand 14 in the groove. By changing the rotational speed of either wheel, the capstan can pull the strand and cause a tensile force therein so as to remove the unnecessary curl in the strand and form a strand with a given tension.

Figure 1:
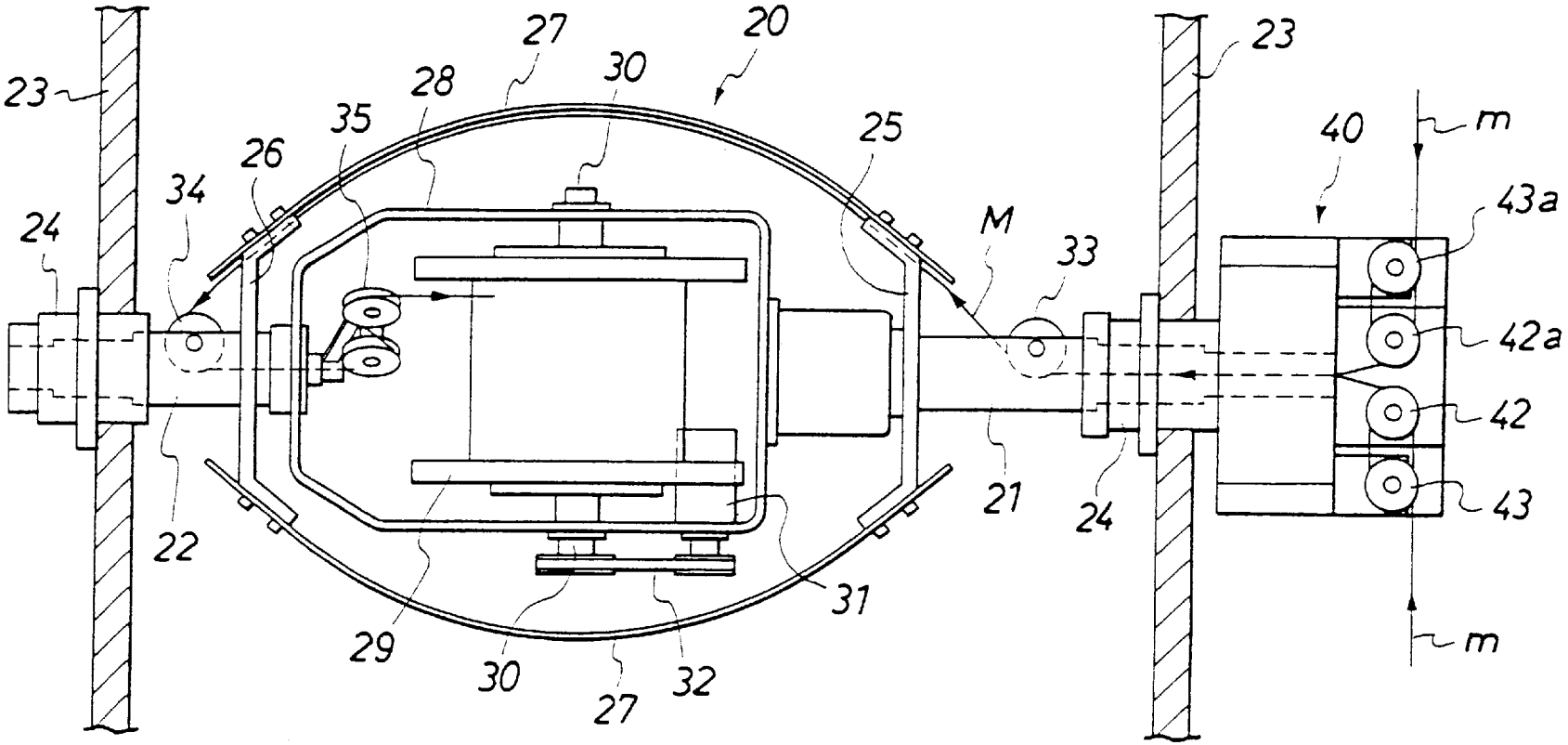
FIG. 1 is a front view of the rotary structure of a wire stranding machine according to the invention.
Figure 2:
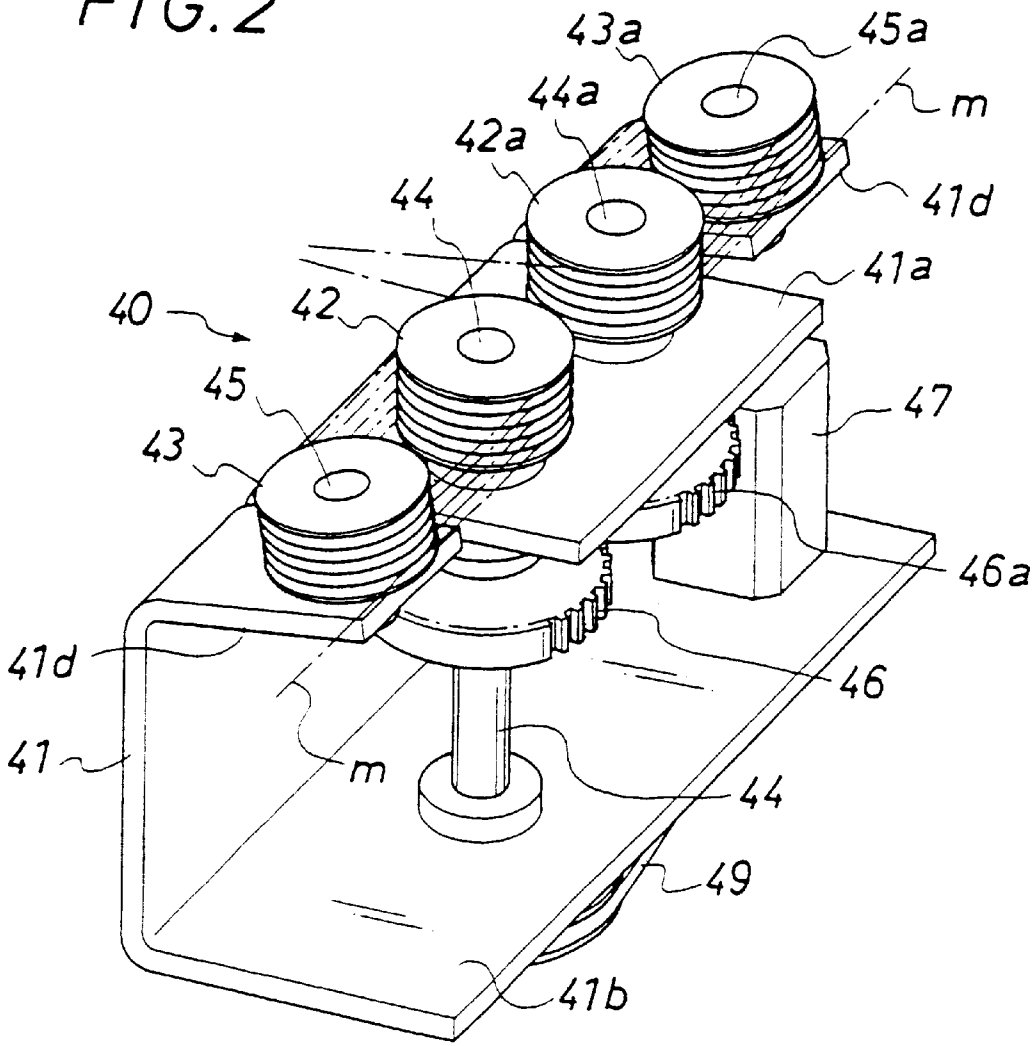
FIG. 2 is a perspective view of the capstan assembly of the invention.
Figure 3:
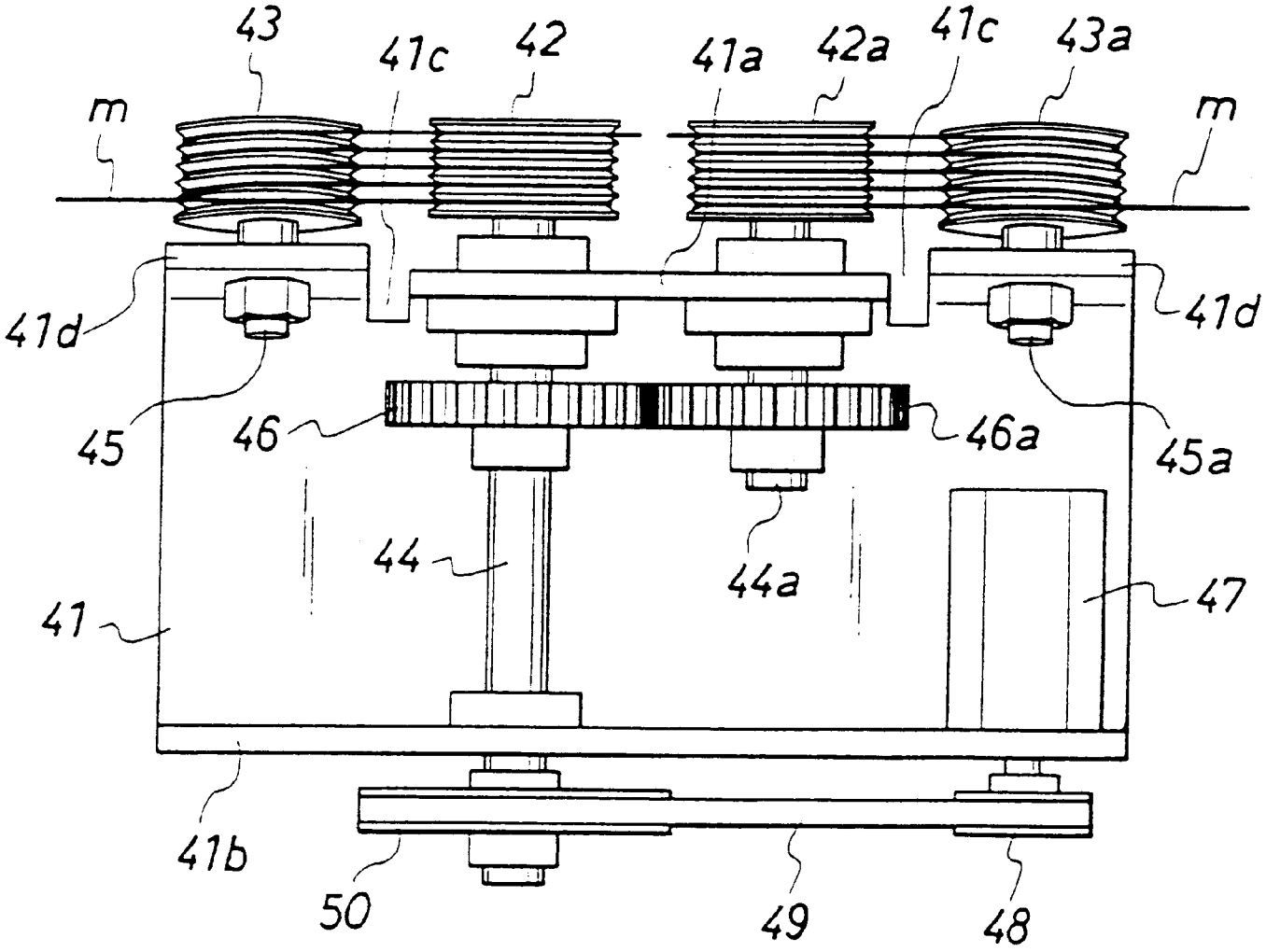
FIG. 3 is a front view of FIG. 2.

FIG. 1 shows a rotary structure of the wire stranding machine, and FIGS. 2 and 3 show a capstan assembly.

In the drawings, a reference numeral 20 indicates the rotary structure forming a major part of the wire stranding machine. Main shafts 21 and 22 supporting the rotary structure at the opposite ends are mounted rotatable to bearing members 24 provided at a frame 23 of the machine. The main shafts 21 and 22 of the rotary structure 20 are arranged concentrically and inserted through the bearing members 24, respectively, and rotary discs 25 and 26 are provided inside of the frame 23. The rotary discs 25 and 26 are mounted with a pair of flyer bows 27. The main shafts 21 and 22 are projecting toward the inner side of the rotary discs 25 and 26, and a drum mounting frame 28 is provided at the projecting portion.

A drum 29 for winding the wires is provided at the drum mounting frame 28, of which a rotatable supporting shaft 30 is mounted detachable in the direction perpendicular to the axis of the main shafts 21 and 22. A motor 31 for rotating the winding drum 29 transmits the rotating force of the drive shaft to the supporting shaft 30 via a belt 32.

The main shafts 21 and 22 are provided with guide rollers 33 and 34 outside of the rotary discs 25 and 26, respectively. The main shafts 21 and 22 are each formed with a longitudinal hole, not shown, for inserting the wires. The main shaft 21 on the right side as viewed at the same level with the rotary structure 20 functions as the shaft on the wire incoming side. From this side comes the wire material M and goes to the guide roller 33, and then it passes through the flyer bow 27 to another guide roller 34, from which it goes into the shaft 22 and then wound up by the winding drum 29.

A traverse guide roller 35 for uniformly rolling the wire material round the winding drum 29 is adapted to be driven by the motor 31 for rotating the winding drum 29 and oscillate in synchronism with the winding drum 29.

Adjacent to the main shaft 21 on the wire incoming side is provided a capstan assembly 40. With reference to FIGS. 2 and 3, the capstan assembly 40 includes a pair of capstan means consisting of main and auxiliary capstans 42 and 43 located on the upper surface of a mounting stand 41. The main capstans 42 and 42*a* are disposed opposite to each other, with the auxiliary capstans 43 and 43*a* being disposed outside thereof, and said capstans are mounted rotatably on rotary shafts 44 and 45.

The rotary shafts 44 and 44*a* are provided with mutually engaged gears 46 and 46*a*, and the shaft 44 is provided with a pulley 50 which is connected via a belt 49 to a pulley 48 mounted on the drive shaft of a motor 47. The rotatory motion of the motor 47 is transmitted via the belt 49 to the rotary shaft 44 so as to rotate the main capstan 42. At the same time, the gears 46 and 46*a* transmit the rotation to another rotary shaft 44*a*, which will rotate the main capstan 42*a* but in the opposite direction. The auxiliary capstans 43 and 43*a* are not provided with the rotation drive means.

The main capstans 42 and 42*a* as well as auxiliary capstans 43 and 43*a* are each formed with plural grooves on the outer circumference thereof and have the identical external diameter. The gears 46 and 46*a* have the identical external diameter and gear tooth pitch so that the main capstans rotate at the same speed but in opposite directions to each other.

The mounting stand 41 is a box-like structure with one side open and has upper and lower surfaces, 41*a* and 41*b*. Outside on the upper surface 41*a* are provided the capstans 42, 42*a*, 43 and 43*a*, and outside on the lower surface 41*b* there are provided the pulleys 48 and 50 constituting the rotation transmitting mechanism. The motor 47 is provided inside of the mounting stand 41.

With reference to FIG. 1, the capstan assembly 40 is provided on the mounting portion of the main shaft 21 supporting the rotary structure 20 so that the main and auxiliary capstans 42,42*a*, 43 and 43*a* are disposed parallel in the direction perpendicular to the axis of the main shaft 21 as well as the main capstans 42 and 42*a* are disposed opposite to each other symmetrically to the center of the axis of the main shaft 21.

The auxiliary capstans 43 and 43*a* are adapted to slant slightly relative to the rotary structure 20. For this arrangement, the upper surface 41*a* is formed with a cut 41*c* between the main and auxiliary capstans, with upper surface portions 41*d* where the auxiliary capstans are provided being raised slightly to the counter-clockwise direction in FIG. 2 so as to slant the rotary shafts 45 and 45*a* slightly relative to the rotary structure.

The slanting of the auxiliary capstans to the main capstans is to hold the wire material m in the grooves when it is being fed from the auxiliary capstan 43 to the main capstan 42. Each wire material m is set in the groove of the auxiliary capstan and then the main capstan and then back to the auxiliary capstan and then again to the main capstan until it is set in all the grooves. Thereafter, the two wire materials are fed simultaneously to the rotary structure 20 (flyer bow 27) from between the main capstans 42 and 42*a*.

The wire material M is supplied via the guide roller 33 to the flyer bow 27, through which it is fed to the opposite guide roller 34 and the traverse guide roller 35 and then coiled around the winding drum 29. When the wire material m is supplied from the capstan assembly 40 to the winding drum 29, the motor 47 of the capstan assembly 40 is set into motion and at the same time the rotation drive means, not shown, for rotating the rotary structure 20 is put into operation. At the same time, the motor 31 to rotate the winding drum 29 is also set into motion.

The motor 47 in motion causes the main capstans 42 and 42*a* to rotate in opposite directions to each other and feed the wire material m from between the main capstans while the wire materials set around the main and auxiliary capstans are being pulled into a strained condition. Therefore, there will occur no slackening in the wire material m while the rotary structure 20 is rotating and the wire material will be stranded at a desired pitch.

Because the main capstans 42 and 42*a* have the same diameter and the same speed of rotation, the wire material m is supplied from both sides for-a fixed amount and at a uniform tension as well, thereby resulting in an evenly stranded product.

Although the embodiment is described with reference to two wire materials being used, it is needless to say that the wire material itself can consist of more than two. Further the rotary structure of the embodiment is placed horizontally but it is also applicable to the vertical type.

As the capstans are placed outside of the rotary structure on the wire incoming side and the wire material is fed into the rotary structure in a strained condition, the wire material will not slacken during the stranding operation and therefore evenly stranded wires are obtainable.

It will be understood that the embodiments described herein are merely exemplary and that a person skilled in the art may make many variations and modifications without departing from the spirit and scope of the invention. All such modification and variations are intended to be included within the scope of the invention as defined in the appended claims.

What is claimed is:

1. A wire stranding machine, comprising:

a rotary structure including a flyer bow, a pair of concentric main shafts supporting said rotary structure at opposite ends, a winding drum inside of said flyer bow and being supported by said main shafts, and a capstan support positioned adjacent to one of said main shafts external to and spaced from the flyer bow at one of said ends for feeding a plurality of wire strands into said one shaft and flyer bow, said capstan support including a pair of capstan devices mounted symmetrically on said support, each device including a main inner capstan and an auxiliary outer capstan, said main capstans being disposed opposite to each other and adapted to rotate at the same speed but in opposite directions for feeding opposing wire strands into said one shaft and flyer bow.

2. The wire stranding machine as in claim 1, wherein said main and auxiliary capstans are arranged in pairs mounted generally parallel to each other and perpendicular to the axis of said one main shaft and the opposite main capstans are disposed symmetrically with relation to the axis of said one main shaft.

3. The wire stranding machine as claimed in claim 1, wherein said pair of main capstans are of the same diameter.

4. The wire stranding machine as in claim 1, including drive means mounted on said capstan support, said drive means including a pair of rotary shafts, said main capstans being mounted on respective rotary shafts, gear means mounted on said rotary shafts in engagement with said drive means, said drive means rotating said shafts in opposite directions at the same speed.

5. The wire stranding machine as in claim 1 wherein said auxiliary capstans slant slightly relative to the rotation of the main capstans for applying a uniform tension to the wire strands.

6. The wire stranding machine as in claim 5 wherein the capstan support includes cut portions raising the mounting portions of the rotary shafts of the auxiliary capstans above the main capstans shafts providing the auxiliary capstans with a slant relative to the position of the main capstans.

* * * * *